US005135124A

United States Patent [19]

Wobser, Gregory S.

[11] Patent Number: 5,135,124

[45] Date of Patent: Aug. 4, 1992

[54] PRESSURE LOCK BAYONET CLOSURE

[75] Inventor: Gregory S. Wobser, Sylvania, Ohio

[73] Assignee: Hoover Universal, Inc., Plymouth, Mich.

[21] Appl. No.: 697,661

[22] Filed: May 9, 1991

[51] Int. Cl.[5] ..... B65D 55/02; B65D 41/06

[52] U.S. Cl. ..... 215/222; 215/223; 215/307; 215/332; 220/293; 220/296; 220/374

[58] Field of Search ..... 215/332, 208, 221, 222, 215/223, 307, 314, 339, 340, 216, 217; 220/293, 296, 298, 366, 374

[56] References Cited

U.S. PATENT DOCUMENTS

| | | | |
|---|---|---|---|
| 1,443,682 | 1/1923 | Gueritey | 220/296 |
| 1,612,449 | 12/1926 | Lee | 215/337 X |
| 1,621,487 | 3/1927 | Aulbach | 220/296 |
| 3,402,842 | 9/1968 | Millian | 215/217 |
| 3,656,647 | 4/1972 | Swinn | 215/208 |
| 3,888,383 | 6/1975 | Rowlands | 220/265 |
| 4,032,028 | 6/1977 | Reiss et al. | 215/217 |
| 4,202,462 | 5/1980 | Imber | 220/293 |
| 4,275,817 | 6/1981 | Patton | 215/217 |
| 4,643,330 | 2/1987 | Kennedy | 220/288 |
| 4,721,220 | 1/1988 | Northup | 215/307 |

*Primary Examiner*—Stephen Marcus
*Assistant Examiner*—Vanessa Caretto
*Attorney, Agent, or Firm*—Harness, Dickey & Pierce

[57] ABSTRACT

A carbonated beverage container having a cap which remains connected to the body of the container during the venting. Interlocking tabs are provided, two sets on the cap and one set on the container body, in a manner which allows the cap to be sufficiently opened to vent the internal pressure of the container. One set of tabs maintain the cap in a sealed relation with the container body while the second set of tabs prevents the cap further rotating during venting. Once the internal pressure has been sufficiently released, the second set of tabs can be disengaged and the cap removed from the container body. The cap is fully engaged and disengaged less than one full rotation of the cap relative to the container body.

16 Claims, 3 Drawing Sheets

PRESSURE LOCK BAYONET CLOSURE

BACKGROUND AND SUMMARY OF THE INVENTION

The present invention relates generally to refillable containers and more particularly to closure assemblies for beverage containers exhibiting internal pressures greater than the ambient pressure. Typically, such containers are used for packaging carbonated beverages.

Traditional closure designs for carbonated beverage containers have utilized a screw-type or threaded connection between the cap and the finish of the container body. The threads of the cap and the finish of the container body are often provided with vents, in the form of vertical channels, which allow the internal pressure of the container to be released as the closure is being opened. These closure designs are such that the cap maintains nearly one complete revolution of engagement, after the integrity of the seal has been broken, to ensure that the cap remains attached to the finish of the container body until substantially all of the internal pressure has been vented.

From a production standpoint, the threaded design exhibits various drawbacks. One drawback is the significant amount of material required to form the threads, both on the finish and the closure. A second drawback, particular of smaller containers, is that the weight of the material forming the finish becomes a significant percent of the total container weight.

To reduce costs, it is desireable to reduce the amount of material required to form the closure and the finish. From a safety standpoint, it is desireable for the cap to remain secured to the finish while the container vents its internal pressure.

A closure design which uses a lesser amount of material, but which is not suitable for use with carbonated beverage containers, is the bayonet closure. The bayonet closure provides for a series of segmented threads on the finish and a series of corresponding tabs on the cap. When the container is closed, the tabs of the cap are positioned beneath the segmented threads and require only a partial twist of the cap, relative to the finish, to be completely disengaged therefrom. The bayonet closure is commonly used with glass containers having metal caps and where the contents of the container exhibit a negative pressure. However, if the bayonet closure were to be used on a container exhibiting a positive internal pressure, the cap would completely separate from the finish prior to the venting of the internal pressure, possibly becoming a dangerous projectile.

With limitations of the above closures in mind, it is an object of this invention to provide a container which permits venting of the pressure within the closed container as it is opened.

A further object of this invention is to maintain the cap connected to the finish of the container body during venting, thereby preventing the cap from becoming a projectile.

Another object of this invention is to provide a closure assembly which requires only a partial revolution of the cap, relative to the finish, to completely engage or disengage the cap therefrom.

It is also an object of this invention to produce a container which exhibits a decreased total weight and which is more cost efficient to produce.

In achieving the above objects, the invention provides for a closure assembly having multiple interlocking segments. The invention utilizes two sets of tabs or bayonets on the cap and a set of corresponding tabs on the finish.

The set of bayonets on the cap, the primary bayonets, serve the purpose of maintaining the cap in a sealed engagement with the finish to close the container. The cap also includes a set of secondary bayonets which are angularly offset from the primary bayonets. The amount of angular offset is approximately that degree of rotation which is needed to fully engage or disengage the primary bayonets from the tabs formed on the finish. The secondary bayonets are also positioned lower on the cap than the primary set. Thus, the position of the secondary bayonets are such that when the cap has been sufficiently rotated to fully disengage the primary bayonets from the tabs of the finish, the secondary bayonets will be positioned for engagement with the tabs. Since the secondary bayonets are positioned lower on the cap than the primary bayonets, the integrity of the seal will be broken as the cap is forced upward by the internal pressure of the container. The offset of the secondary bayonets ensures that the secondary bayonets engage the tabs of the finish and secure the cap to the finish while the internal pressure is vented.

A safety tab is also provided on the secondary bayonets and a notch formed in the tab of the finish is provided to receive the safety tab. The coacting of the safety tab and the notch prevents the cap from being further rotated or fully disengaged from the finish until the internal pressure of the container has been sufficiently and substantially vented. Once sufficient venting has been achieved, the cap may be depressed slightly, thereby disengaging the safety tab from the notch, allowing for rotation to continue until the cap is fully disengaged from the finish.

Further objects, features and advantages of the invention will become apparent from a consideration of the following description and the appended claims when taken in connection with the accompanying drawings.

DETAILED DESCRIPTION OF THE PREFERRED EMBODIMENT

Figure 2:
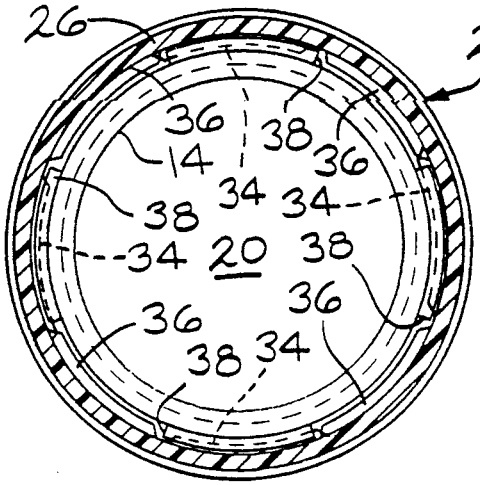
FIG. 2 is a top sectional view of a cap being mounted to the finish in accordance with the principles of the present invention.
Figure 3:
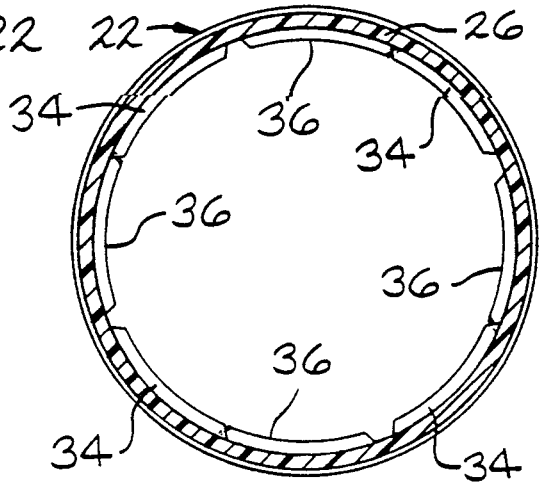
FIG. 3 is a sectional view taken substantially along line 3—3 in FIG. 1 illustrating the offset positioning of the two sets of bayonets formed on the cap.
Figure 1:
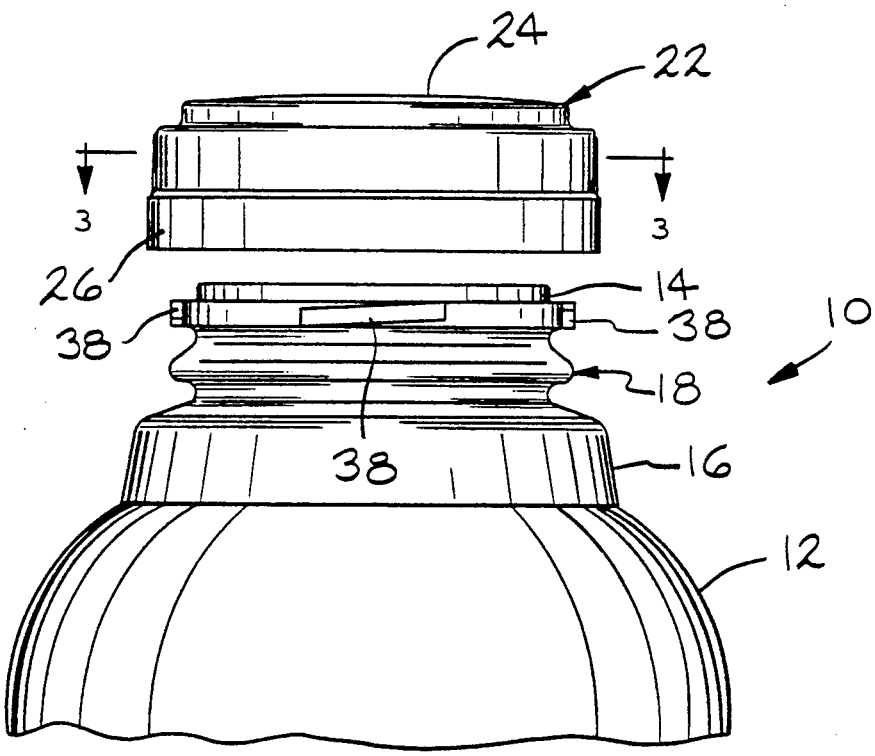
FIG. 1 is a side elevation view of a portion of a container embodying the principles of the present invention.

Now with reference to the drawing, a portion of a container embodying the principles of the present invention is illustrated in FIG. 1 and generally designated at 10. The container 10 includes a hollow body 12 having an annular mouth 14 and a neck 16 formed on the upper end thereof. The mouth 14 defines a central opening 20 which permits the contents within the cavity of the hollow body 12 to be dispensed therefrom. The top of the hollow body 12, including both the mouth 14 and the neck 16, is generally referred to as the finish of the container 10 and will be hereinafter referred to as "finish 18".

While the container 10 may be used for packaging various materials, it is believed that a container 10 embodying the principles of this invention will find particular utility with materials requiring packaging under pressure, in particular, carbonated beverages. Furthermore, while it is anticipated that the container will be constructed of plastic, other materials, such as glass and metal, could also be used.

To seal the carbonated beverage in the container 10, a cap 22 is provided which will mount on the finish 18. Generally, the cap 22 includes a central body or disc 24 and a depending skirt 26. The skirt 26 extends downwardly from the periphery of the central body 24 and will exteriorly encircle a portion of the finish 18 once the cap 22 is mounted thereon. The skirt 26 includes an integrally formed tamper ring 28 (FIGS. 4A and 4B) which will be severed from the skirt 26 upon initial opening of the container 10.

When the cap 22 is fully engaged with the finish 18 (see FIGS. 4A and 4B), the central disc 24 will obstruct the opening 20 of the hollow body 12, thereby sealing the container 10. The cap 22 is further provided with a gasket 30 which will circumferentially engage a seating ring 32, formed around the mouth 14, and ensures a fluid tight seal.

Figure 10A:
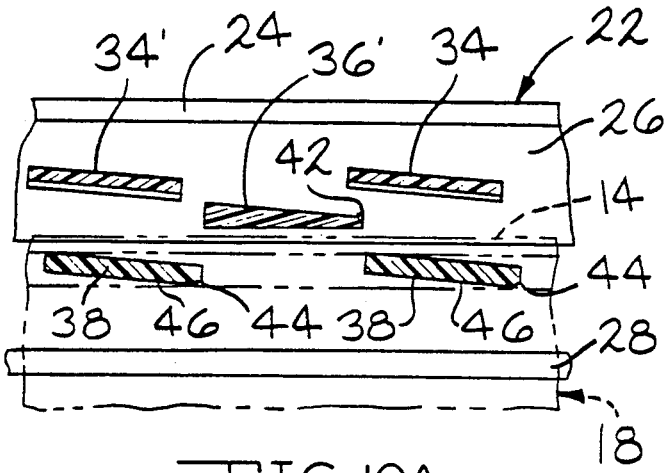
FIG. 10A is a developed diagrammatic side view showing the cap being removed from the finish after opening of the container.
Figure 10B:
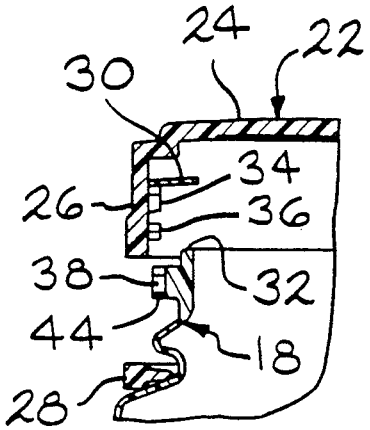
FIG. 10B is a partial section view of the closure assembly shown in FIG. 10A.

As may be best seen in FIGS. 1 and 10, both the cap 22 and the finish 18 are provided with tabs or bayonets (also known as segmented threads). Two sets of bayonets or tabs are provided interiorly on the dependent skirt 26 and are hereinafter referred to as primary bayonets 34 and secondary bayonets 36. One set of bayonets or mating tabs 38 are provided on the exterior surface of the finish 18 so as to extend radially outward therefrom. Both the tabs 38 and the bayonets 34 and 36 exhibit sloped or ramped engagement surfaces (further described below) which allow for a downward sealing force to be applied to the cap 22.

Figure 4A:
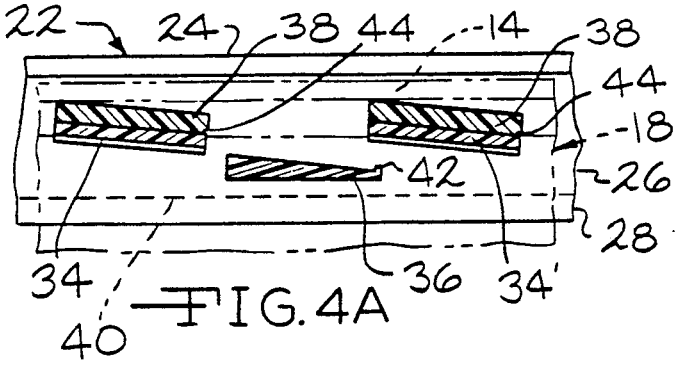
FIG. 4A is a developed diagrammatic side view of a fully engaged closure assembly according to the principles of the present invention.
Figure 4B:
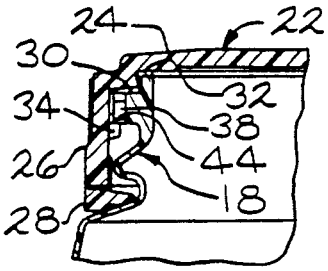
FIG. 4B is a partial sectional view of the fully engaged closure assembly illustrated in FIG. 4A.

The primary bayonets 34 serve the traditional purpose of maintaining the cap 22 in engagement with the finish 18 to seal and close the container 10. As seen in FIGS. 4A and 4B, when the container 10 is closed, the primary bayonets 34 extend radially inward from the skirt 26 and engage the mating tabs 38 so as to pull the cap 22, and in particular the central disc 24, downward into a position which obstructs the opening 20 of the mouth 14. To initiate opening of the container 10, the cap 22 is partially rotated counterclockwise relative to the finish 18. The amount of rotation is equal to that necessary for fully disengaging the primary bayonets 34 from the mating tabs 38 and is thus approximately equal to the circumferential length of the primary bayonets 34.

For the sake of clarity, during the relative movement and rotation of the cap 22 with respect to the finish 18, various elements will be designated with a prime (′). For example, one of the primary bayonets 34 will be designated as 34′. This designation will be maintained throughout the bayonet's 34′ entire range of movement allowing for the operation of the invention to be more readily followed.

Figure 5:
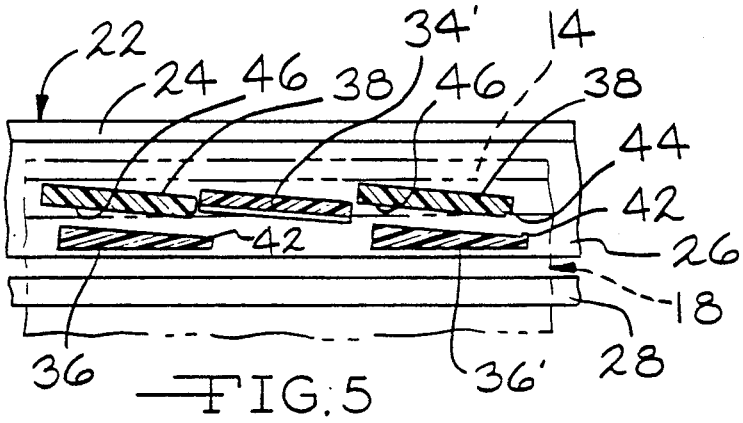
FIG. 5 is a developed diagrammatic side view of the closure assembly seen in FIG. 4A after being partially rotated to begin disengagement of the cap from the finish.
Figure 6A:
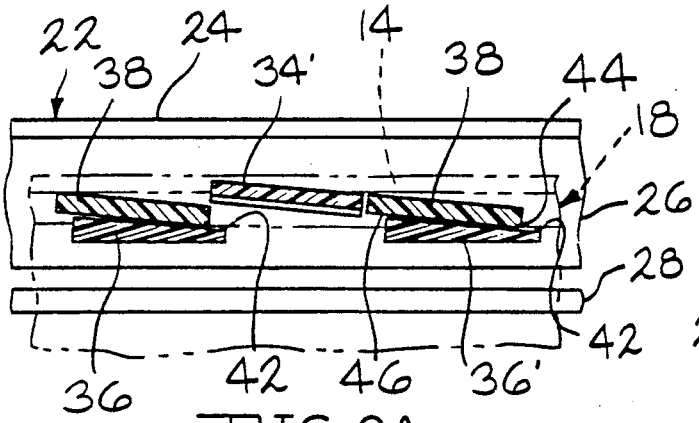
FIG. 6A is a developed diagrammatic side view like FIG. 5 after the closure assembly has moved upwardly to a position in which the secondary bayonets engage the tabs of the finish during venting.
Figure 6B:
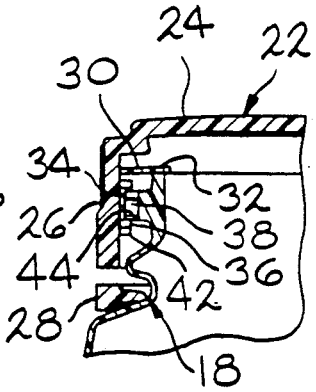
FIG. 6B is a partial sectional view of the closure assembly during venting as shown in FIG. 6A.

As seen in FIG. 5, the mating tabs 38 are spaced apart a distance which is greater than the circumferential length of the primary bayonets 34. With the cap 22 partially rotated, the internal pressure of the container 10 will cause the cap 22 to be moved upward.

To permit severing of the tamper ring 28 from the dependent skirt 26, the tamper ring 28 is defined by a score line 40 and fixed relative to the finish 18 after engagement thereon. During initial rotation and upward movement of the cap 22, the score line 40 is fractured and the tamper ring 28 remains on the finish 18 providing evidence that the container 10 has been previously opened.

The secondary bayonets 36 and 36′ extend radially inward from the skirt 26 and are angularly offset from the primary bayonets 34 and 34′. The degree of offset approximately equals the degree of rotation required for fully disengaging the primary bayonets 34 and 34′ from the mating tabs 38. As the primary bayonets 34 move upward between the mating tabs 38, the integrity of the seal formed by the gasket 30 and the seating ring 32 is broken and the internal pressure begins to vent. With the upward movement of the cap 22, the secondary bayonets 36 and 36′ become engaged with the mating tabs 38 and prevent removal of the cap 22. While engaged, the secondary bayonets 36 and 36′ allow for continued venting of the internal pressure and eliminate the dangers involved with the cap 22 becoming a projectile.

To further ensure that the cap 22 is retained on the finish 18, the secondary bayonets 36 and 36′ are provided with upwardly extending fingers 42 which correspondingly engage notches 44 formed in the lower engagement surfaces 46 of the mating tabs 38. The internal pressure of the container 10 urges the fingers 42 upward into the notches 44 of the mating tabs 38 and the cap 22 is inhibited from being further rotated until the internal pressure has been safely and substantially vented.

Figure 7:
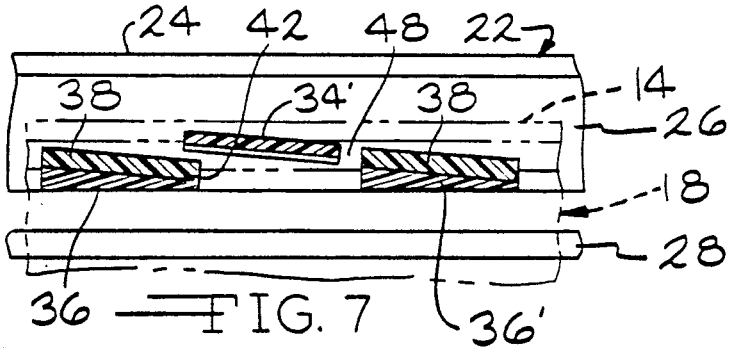
FIG. 7 is a developed diagrammatic side view illustrating engagement of the safety tabs with the notches to prevent further rotation of the cap during venting.
Figure 8:
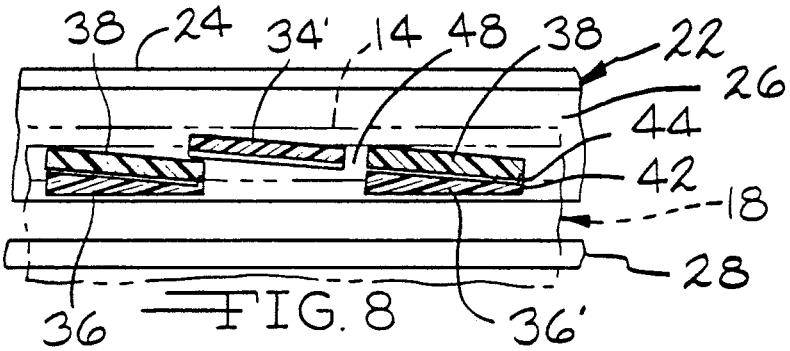
FIG. 8 is a developed diagrammatic side view of the cap being depressed relative to the finish so as to disengage the safety tabs after venting.

As seen in FIG. 7, when the safety tabs 42 are engaged in the notches 44, the offset positions of the primary and secondary bayonets 34 and 36 allow substantially vertical vent channels 48 to be formed by the corresponding portions of the cap 22 and finish. The vent channels 48 will increase the rate at which the container 10 is vented.

Figure 9:
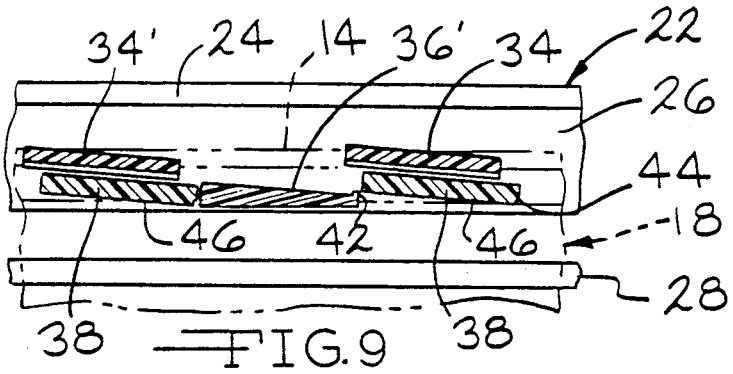
FIG. 9 is a developed diagrammatic side view of the cap after being rotated to a fully disengaged position relative to the finish.

Once vented, the cap 22 can be sufficiently depressed to disengage the fingers 42 from the notches 44. Once disengaged, the cap 22 may be partially rotated to disengage the secondary bayonets 36 from the mating tabs 38, as seen in FIG. 9. The cap 22 is then upwardly removed from the finish 18 as the secondary bayonets 36 are permitted to pass between an adjacent pair of mating tabs 38.

The cap 22 can be re-engaged upon the finish 18, resealing the container 10, by generally reversing the procedure describe above.

From the above discussion, it can be seen that the container 10 can be fully opened and closed with only a partial rotation, less than 360°, of the cap 22 relative to the finish 18. With the threads no longer being required to encircle the finish 18 of the container 10, present invention achieves a reduction of the amount of material required to form the cap 22 and finish 18. The reduced amount of material results in a lighter and more economically produced container 10.

While the above description constitutes the preferred embodiment of the present invention, it will be appreciated that the invention is acceptable to modification, variation and change without departing from the proper scope and fair meaning of the accompanying claims.

What is claimed is:

1. A closure assembly for a material packaged under pressure in a container having a hollow body defining an internal cavity and including a finish region having a substantially cylindrical neck portion formed at an upper end of said hollow body, said finish region terminating in a generally annular mouth defining an opening, a closure cap being engageable with said finish region in an obstructing relationship with said opening to close said container, said closure assembly comprising:

a plurality of spaced apart retaining tabs formed on said finish region, a plurality of spaced apart primary tabs formed on said closure cap and being engageable with said retaining tabs to sealingly engage said closure cap with said finish region and maintain the pressure within the container, said closure cap being disengageable from said finish region upon rotation of less than three hundred and sixty degrees relative to said finish region, said closure cap being rotatable to a vent position in which said primary tabs are between said retaining tabs allowing said closure cap to move upwardly, a plurality of secondary tabs formed on said closure cap and being engageable with said retaining tabs in response to upward movement of said closure cap, means for preventing removal of said closure cap from said hollow body until the pressure has been substantially vented from the container.

2. A container as set forth in claim 1 wherein said retaining tabs are equidistantly spaced around said finish region, said primary tabs also being equidistantly spaced around said closure cap, and said secondary tabs also being equidistantly spaced around said closure cap.

3. A container as set forth in claim 2 wherein said primary tabs are formed on an interior surface of said closure cap and extend generally transversely inward therefrom, said primary tabs exhibiting generally sloped upper engagement surface.

4. A container as set forth in claim 3 wherein said secondary tabs are formed on said interior surface and extend generally radially inward therefrom, said secondary tabs also including a generally sloped upper engagement surface.

5. A container as set forth in claim 4 wherein said secondary tabs are longitudinally spaced apart from said primary tabs so as to be positioned lower on said closure cap, said secondary tabs also being angularly offset from said primary tabs.

6. A container as set forth in claim 4 wherein said retaining tabs are formed on an exterior surface of said finish region and extend generally radially outward therefrom, said retaining tabs including a generally sloped lower engagement surface which coacts with said sloped upper engagement surfaces of said primary tabs to retain said closure cap on said finish region thereby closing said container, said sloped lower engagement surface coacting with said sloped upper engagement surface of said secondary tabs to retain said closure cap on said finish region while permitting venting of pressure within the container.

7. A container as set forth in claim 2 wherein said preventing means includes a finger extending upwardly from said secondary tabs.

8. A container as set forth in claim 7 wherein said retaining tabs include a recessed notch being formed in a lower engagement surface thereof, said notch generally corresponding to said finger, said finger and said notch coacting to prevent further rotation of said closure cap relative to said hollow body until the internal pressure of the container has been substantially released.

9. A closure assembly for a material packaged under pressure in a container having a hollow body defining an internal cavity and including a finish region having a substantially cylindrical neck portion formed at an upper end of said hollow body, said finish region terminating in a generally annular mouth defining an opening, a closure cap being engageable with said finish region in an obstructing relationship with said opening to close said container, said closure assembly comprising:

a plurality of spaced apart retaining tabs formed on said finish region, a plurality of spaced apart primary tabs formed on said closure cap and being engageable with said retaining tabs to sealingly engage said closure cap with said finish region and maintain the pressure within the container, said closure cap being disengageable from said finish region upon rotation of less than three hundred and sixty degrees relative to said finish region, said closure cap being rotatable to a vent position in which said primary tabs are between said retaining tabs allowing said closure cap to move upwardly, a plurality of secondary tabs formed on said closure cap and being engageable with said retaining tabs in response to upward movement of said closure cap to prevent removal of said closure cap from said hollow body until the pressure has been substantially vented from the container, said secondary tabs including a finger extending upwardly therefrom and interferingly engaging said retaining tabs when said secondary tabs are engaged therewith.

10. A closure assembly for a carbonated beverage container as set forth in claim 9 wherein said primary and secondary tabs are interiorly formed on said skirt and extend generally radially inward therefrom.

11. A closure assembly for a carbonated beverage container as set forth in claim 10 wherein said primary tabs are substantially equidistantly spaced circumferentially around said skirt.

12. A closure assembly for a carbonated beverage container as set forth in claim 11 wherein said secondary tabs are substantially equidistantly spaced circumferentially around said skirt.

13. A closure assembly for a carbonated beverage container as set forth in claim 12 wherein said primary tabs and said secondary tabs are longitudinally spaced apart from one another on said skirt positioning said secondary tabs lower thereon.

14. A closure assembly for a carbonated beverage container as set forth in claim 13 wherein said primary tabs and secondary tabs are angularly spaced apart from one another in an offset relation around said skirt.

15. A closure assembly for a carbonated beverage container as set forth in claim 14 wherein said primary tabs and said secondary tabs are angularly spaced apart and coact to define a vent channel when said secondary tabs are engaged with said retaining tabs.

16. A closure assembly for a carbonated beverage container as set forth in claim 15 wherein said vent channel is substantially vertical.

* * * * *